US006834476B2

(12) United States Patent
Konishi

(10) Patent No.: US 6,834,476 B2
(45) Date of Patent: Dec. 28, 2004

(54) SEALING AND PACKAGING DEVICE FOR COVER FILM ON TRAY

(75) Inventor: Kazuo Konishi, Takatsuki (JP)

(73) Assignee: Ibaraki Seiki Machinery Company, Ltd., Osaka (JP)

( * ) Notice: Subject to any disclaimer, the term of this patent is extended or adjusted under 35 U.S.C. 154(b) by 0 days.

(21) Appl. No.: 10/688,529

(22) Filed: Oct. 17, 2003

(65) Prior Publication Data

US 2004/0098947 A1 May 27, 2004

(30) Foreign Application Priority Data

Oct. 17, 2002 (JP) ..... 2002-302427
Dec. 9, 2002 (JP) ..... 2002-356295
Jul. 9, 2003 (JP) ..... 2003-272126

(51) Int. Cl.[7] ..... B65B 51/10

(52) U.S. Cl. ..... 53/329.5; 53/329.4; 53/556; 53/373.5

(58) Field of Search ..... 53/373.4, 373.5, 53/373.7, 375.4, 375.6, 287, 447, 329.3, 448, 329.4, 556, 329.5

(56) References Cited

U.S. PATENT DOCUMENTS 3,673,760 A * 7/1972 Canamero et al. ..... 53/478
4,796,405 A * 1/1989 Owen et al. ..... 53/556
4,974,392 A * 12/1990 Mondini ..... 53/329
5,155,974 A * 10/1992 Garwood ..... 53/329.3
5,182,896 A * 2/1993 Maccherone ..... 53/329.5
5,247,746 A * 9/1993 Johnson et al. ..... 53/478
5,249,410 A * 10/1993 Bakker et al. ..... 53/329.5
5,475,965 A * 12/1995 Mondini ..... 53/329.3
5,689,937 A * 11/1997 Gorlich et al. ..... 53/433
6,305,149 B1 * 10/2001 Gorlich et al. ..... 53/329.5
6,351,928 B2 * 3/2002 Torre ..... 53/329.3
6,488,972 B1 * 12/2002 Cerani ..... 53/556
6,718,736 B2 * 4/2004 Oguri et al. ..... 53/373.4

* cited by examiner

*Primary Examiner*—Louis Huynh
(74) *Attorney, Agent, or Firm*—D. Peter Hochberg; Sean Mellino; Katherine R. Vieyra

(57) ABSTRACT

The present invention heat-seals a cover film onto a tray accommodating an item to be packaged, without creating wrinkles in the film. In the present invention, respective touch bars provided at equidistant intervals on chains respectively and continuously move trays accommodating items to be packaged, and a frame to which sealers of the same outline as the trays are fixed moves back and forth at the same speed, in the same direction as the trays. A crank below the frame moving back and forth raises a sealing base frame upwards when the frame advances, the trays are pushed against the sealers positioned above the same, via the moving film, and the film is welded to the open edge of the trays. The movement of the sealing base frame is a box motion, and the efficiency of the sealing operation is increased.

7 Claims, 12 Drawing Sheets

FIG. 13

| | | | | |
|---|---|---|---|---|
| GENERAL FRAME | RETREAT | ADVANCE | | RETREAT |
| FILM 41 | ADVANCE | | | |
| TOUCH BAR 12 | ADVANCE | HALT | ADVANCE | |
| SEALING BASE FRAME 28 | MOVE DOWNWARD | MOVE UPWARD | | MOVE DOWNWARD |

FIG. 14

| | | | | |
|---|---|---|---|---|
| GENERAL FRAME | RETREAT | ADVANCE | | RETREAT |
| FILM 41 | ADVANCE | HALT | ADVANCE | |
| TOUCH BAR 12 | ADVANCE | RETREAT | ADVANCE | |
| SEALING BASE FRAME 28 | MOVE DOWNWARD | MOVE UPWARD | | MOVE DOWNWARD |

SEALING AND PACKAGING DEVICE FOR COVER FILM ON TRAY

BACKGROUND OF THE INVENTION

1. Field of the Invention

The present invention relates to a sealing and packaging device, wherein respective individual trays disposed at equidistant intervals in a column fashion, and band-shaped cover film for covering these respective trays, are moved and conveyed at the same speed on a conveyor line, the band-shaped cover film being welded successively to an edge flange portion of each tray.

2. Description of the Related Art

In what are commonly known as tray packaging machines, conventionally, there have existed devices having a structure wherein individual trays for respectively accommodating items to be packaged are disposed in a plurality of mould frames supported at equidistant intervals on an endless chain, these trays being conveyed along an endless path in a unified manner with the chain, while band-shaped cover film is fed over each of the trays, the film furthermore being welded to a flange portion at the edges of each tray, by means of a heating frame which descends from above. A merit is obtained in that the packaged item output by the packaging machine emphasizes the freshness of the food product accommodated in the tray, due to the transparency of the cover film which is attached horizontally to the upper face of each tray. However, if the packaged item is accommodated in the tray in a mounded fashion, then a problem arises in that the cover film covering same will be deformed into a bulging shape and will create a plurality of pleats.

U.S. Pat. No. 6,488,972 discloses a device which does not form pleats in the cover film. As illustrated in FIG. 16, U.S. Pat. No. 6,488,972 is a reference which relates to a device wherein an endless stretching frame 102 is pressed down about the perimeter of an item to be packaged 101, which is accommodated in a mounded fashion in a tray 100, and is pressed against the tray 100 while stretching the stretch film 103 against the resistance of the item to be packaged 101, in addition to which, the film 103 is welded to a flange on the perimeter edge of the tray by means of a heat sealer (sealing frame) disposed around the periphery of the stretching frame 102. The packaging machine described in this reference does have a merit in that pleating of the cover film is eliminated. However, when the stretch film 103 is stretched by the stretching frame 102, since the stretching frame 102 stretches the film 103 by means of friction, a plurality of wrinkles 104 are generated as a secondary effect in the portion of the film about the frame 102 which is not stretched. Consequently, this wrinkled portion becomes welded to the tray 100 by the heat sealer. Therefore, a problem arises in that the wrinkled portion 104 is liable to peel away from the tray 100, due to the elastic restoring force of the film that has been stretched.

SUMMARY OF THE INVENTION

The object of the present invention is to weld the film without forming wrinkles about the perimeter of the tray, when an item to be packaged which is accommodated in a mounded fashion in a tray is hermetically packaged by means of cover film. In other words, the present invention is suitable for the efficient hermetic packaging of block type items to be packaged, which stand up above a tray, without forming wrinkles in the cover film.

The present invention comprises: means for moving touch bars provided at equidistant intervals and spanning between endless chains in respective side positions, in a unified manner with the chains, and pushing and advancing respective trays along the upper face of a horizontal conveyance path, at equidistant intervals in a column fashion, by means of the respective touch bars; a general frame moving back and forth reciprocally in the same direction as the touch bars, in a cutaway region in an intermediate part of the conveyance path; bridge plates fixed to the general frame and moving back and forth reciprocally in a unified manner with the general frame, within the cutaway region at the same height as the face of the conveyance path; a lifting mechanism for moving a sealing base frame disposed surrounding the bridge plates, upwards and downwards, about the periphery of the bridge plates, in response to the reciprocal movement of the frame; sealers fixed to the general frame above the sealing base frame and having the same outline as the open edge of the tray supported on the sealing base; and a film conveyance mechanism for moving a band-shaped film between the sealers and the bridge plates, in the same direction as the touch bars; being composed in such a manner that, when the lifting mechanism performs an upward movement, the band-shaped film is pressed by the sealing base frame against film pushing elements disposed in isolated fashion about the periphery of the sealers, and, with further upward movement of the lifting mechanism, the band-shaped film is pressed against the sealers and welded by same at the open edge of the trays placed on the sealing base, while the band-shaped film is pushed upwards by a to-be-packaged item accommodated in the tray in a mounded fashion, and furthermore, the band-shaped film is pressed against endless blades surrounding the periphery of the sealers and is cut out in accordance with the outlines of the trays.

Moreover, the present invention comprises: means for moving touch bars provided at equidistant intervals and spanning between endless chains in respective side positions, in a unified manner with the chains, and pushing and advancing respective trays along the upper face of a horizontal conveyance path, at equidistant intervals in a column fashion, by means of the respective touch bars; a general frame provided in a fixed manner in a cutaway region in an intermediate part of the conveyance path; bridge plates provided in a fixed manner on the general frame within the cutaway region at the same height as the face of the conveyance path; a lifting mechanism for moving a sealing base frame disposed surrounding the bridge plates, upwards and downwards; sealers fixed to the general frame above the sealing base frame and having the same outline as the open edge of the trays supported on the sealing base; and a film conveyance mechanism for causing a band-shaped film to move between the sealers and the bridge plates, intermittently, in the same direction as the touch bars.

In U.S. Pat. No. 6,488,972, described above, since stretch film is pressed against a tray while being stretched by a stretching frame about a to-be-packaged item accommodated in a mounded fashion in the tray, a wrinkled section occurring at the periphery of the endless frame is welded to the tray by the heating frame, but in the present invention, since the portion to the inner side of pushing elements, where wrinkles are not liable to occur, is welded, occurrences such as peeling off of the welded section due to wrinkling are eliminated, and exposure of the packaged item to the air is prevented.

BRIEF DESCRIPTION OF THE DRAWINGS

FIG. 13 is a diagram for describing the movement of each member of the device;

FIG. 14 is a diagram for describing movement of each member of a device according to a second embodiment;

DESCRIPTION OF THE PREFERRED EMBODIMENTS

The present invention achieves a composition whereby a cover film is held in such a manner that pleats are formed outside the perimeter edge of a tray, rather than inside the perimeter edge thereof, and the film is welded to the tray on the inner side of the held portion.

Embodiment 1

Figure 1:
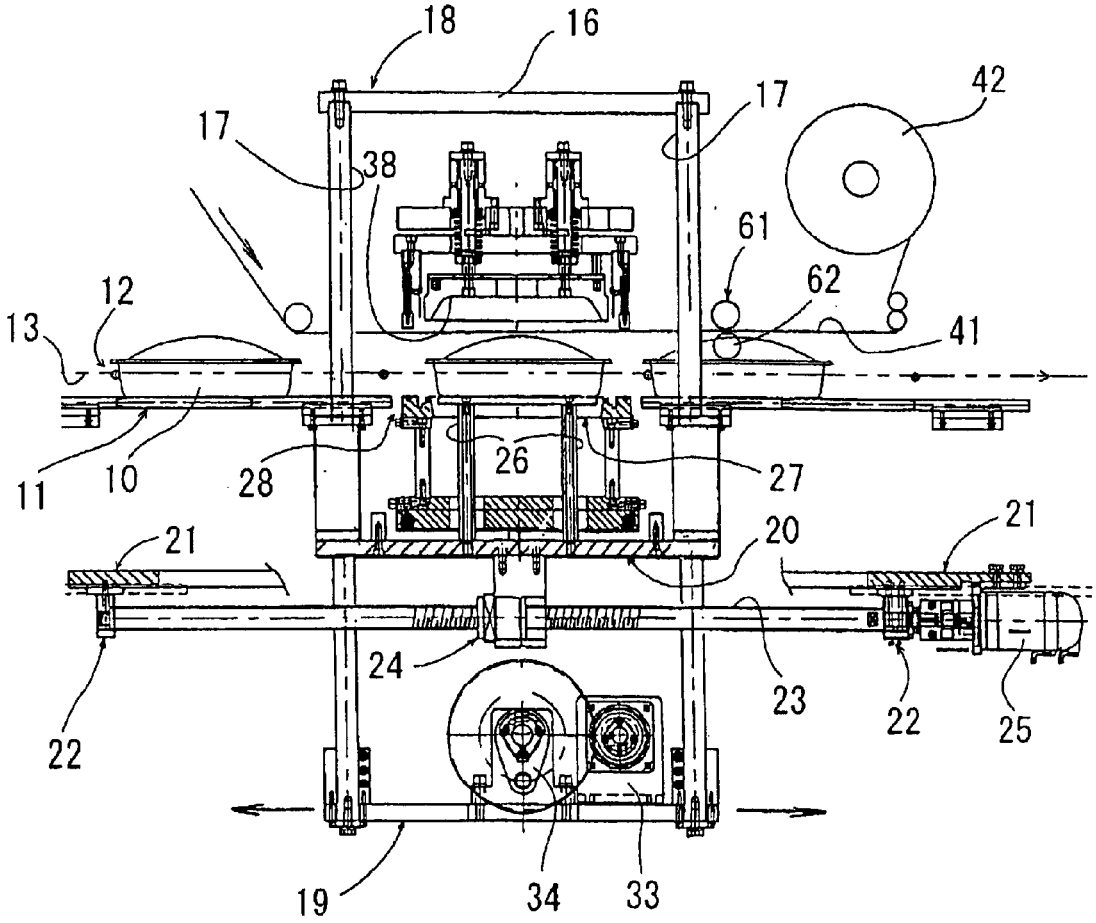
FIG. 1 is a side view of a device according to the present invention.
Figure 2:
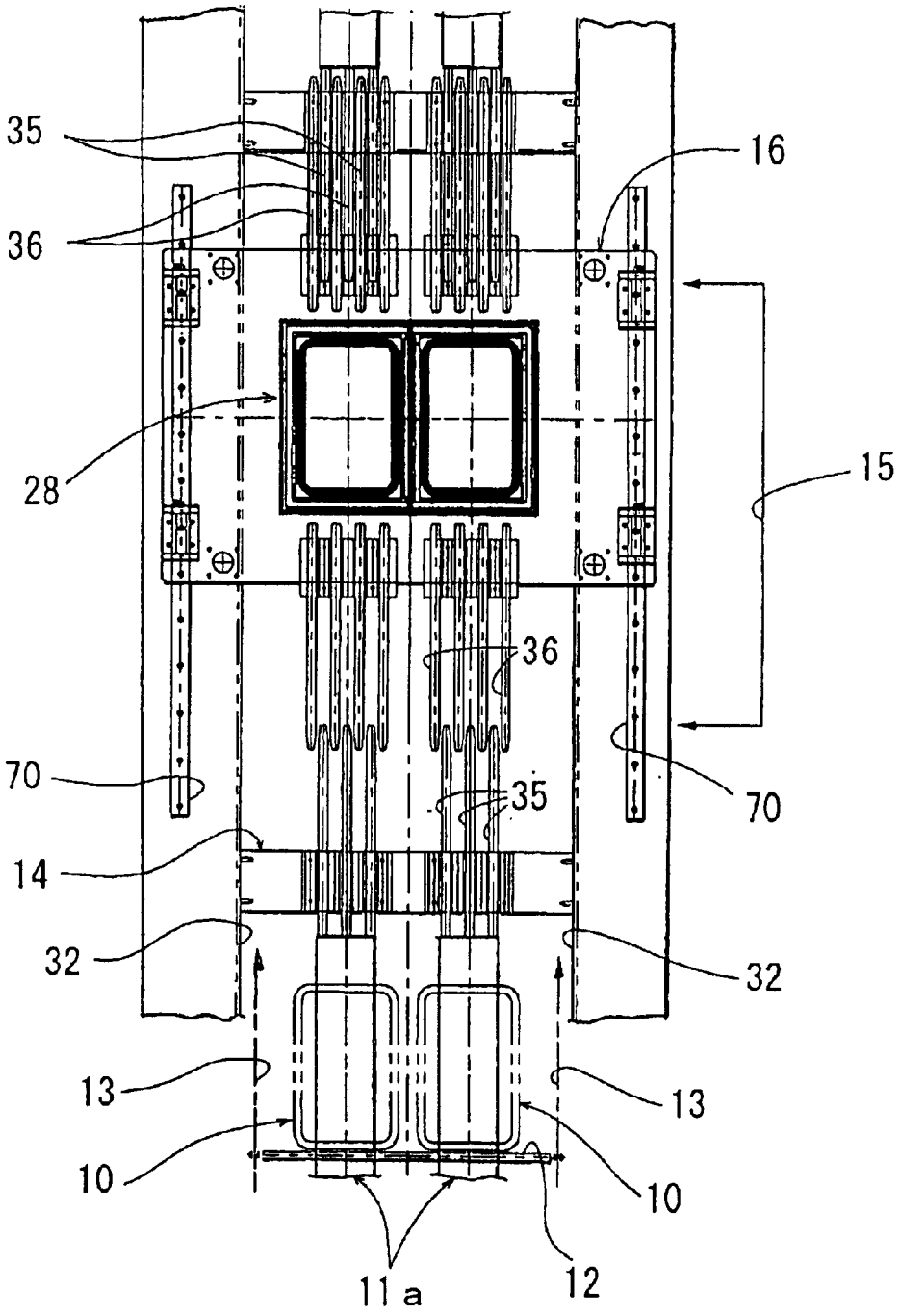
FIG. 2 is a plan view of the device according to the present invention.

Touch bars 12 supported at equidistant intervals on endless chains 13 push and advance trays 10, at equidistant intervals, along the upper face of the horizontal conveyance path 11 in FIG. 1. More specifically, two path of travel plates 11*a* for the purpose of a conveyance path are disposed on stays 14 which are provided spanning between a pair of side plates 32 provided at respective side positions, as illustrated in FIG. 2, and a pair of endless chains 13 are disposed on either side of this conveyance path, the touch bars 12 being provided spanning between the endless chains 13. The trays 10 are caused to perform sliding movement over the path of travel plates 11*a*, by means of the touch bars 12 spanned between the two chains.

A cutaway region 15 is formed in an intermediate part of the conveyance path 11, and a general frame 16 disposed so as to extend through this region is capable of reciprocal movement along side rails 70 disposed at respective side positions.

In the general frame 16 in FIG. 1, pillar members 17 are installed in a standing manner in four respective corners, the upper and lower parts of the pillar members 17 being fixed respectively to a top plate 18 and a bottom plate 19, and the intermediate parts thereof being fixed to an intermediate plate 20. Moreover, a screw bar 23 having a large lead is supported between a pair of bearings 22, 22 fixed to a continuous immobile machine platform 21, and the screw bar 23 is screwed into a female screw block 24 fixed to the intermediate plate 20 of the general frame. A composition is adopted whereby, by forward or reverse rotation of a servo motor 25 which is coupled to one end of the screw bar 23, the screw bar 23 is caused to rotate and the female screw block 24 is caused to move, in such a manner that the general frame 16 performs forward and backward movement. Bridge plates 27 are provided on a plurality of legs 26 erected in a standing fashion on the intermediate plate 20, at the same height as the conveyance path 11 (for further detail, see FIG. 6).

Figure 8:
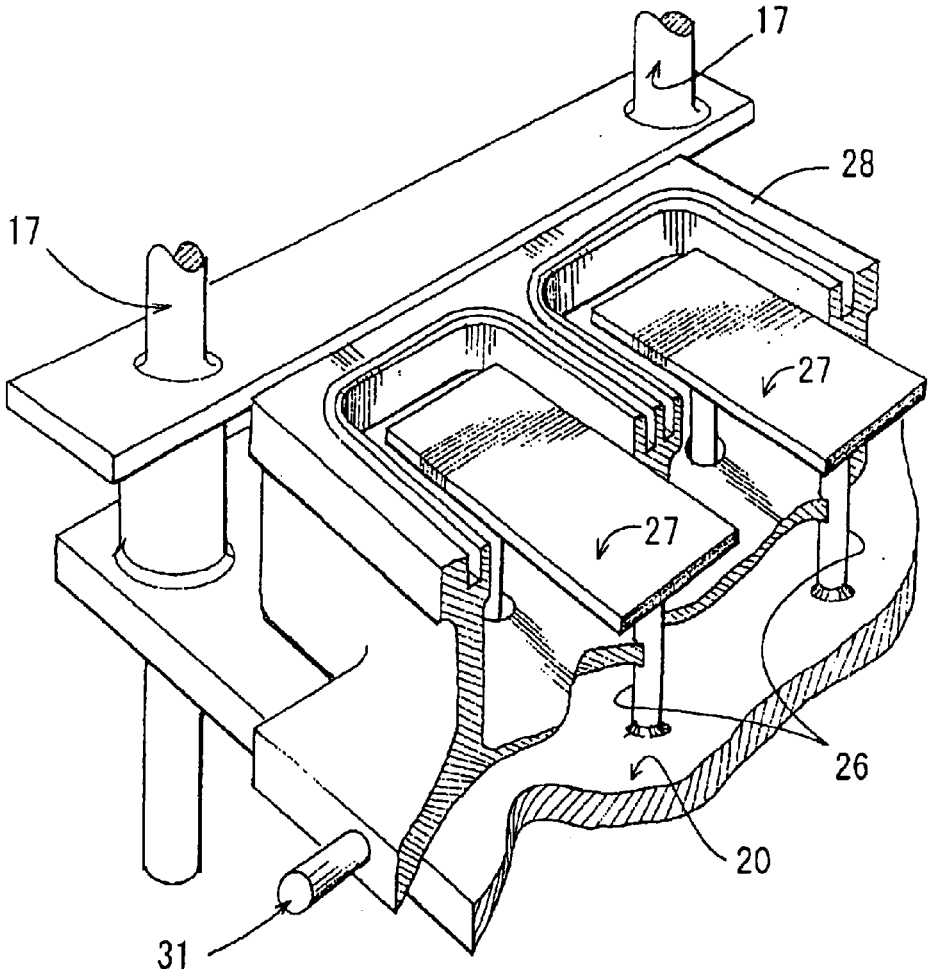
FIG. 8 is a partial oblique view of a general frame.

FIG. 8 is a partial oblique view of the general frame 16 described previously, wherein two bridge plates 27 are fixed in a mutually parallel fashion by means of legs 26 on an intermediate plate 20 which is fixed to the pillar members 17 in the four corners, and a sealing base frame 28 is installed in a state whereby it makes contact with the perimeter of the bridge plates 27. If it is supposed that trays 10 are mounted on the bridge plates 27, then these trays 10 can be pressed upwards while being supported by the sealing base frame 28, by a force in the vertical direction which acts on pins 31 in the side faces of the bed frame 28. A crank 34 which is turned by a motor 33 as illustrated in the lower portion of FIG. 1 forms a shift mechanism for causing upward and downward movement of the sealing base frame 28 in the upper portion, by means of con rods 40, via the pin 31.

The sealing base frame 28 shown in FIG. 2 is also provided with a rim which receives two trays in a parallel fashion. Extendable and contractable transfer regions 36 having a finger shape which slide between a plurality of bars 35 of the same finger shape fixed to the path of travel plates 11*a* are respectively supported at the front and the rear of the general frame 16. Therefore, when the general frame 16 performs reciprocal movement, the trays 10 pushed by the touch bars 12 pass from the conveyance path 11, over the extending and contracting transfer regions 36, and are transferred onto the bridge plates 27 inside the seal base plate 28, upon which it becomes possible for them to be ejected from the bridge plates 27.

Figure 3:
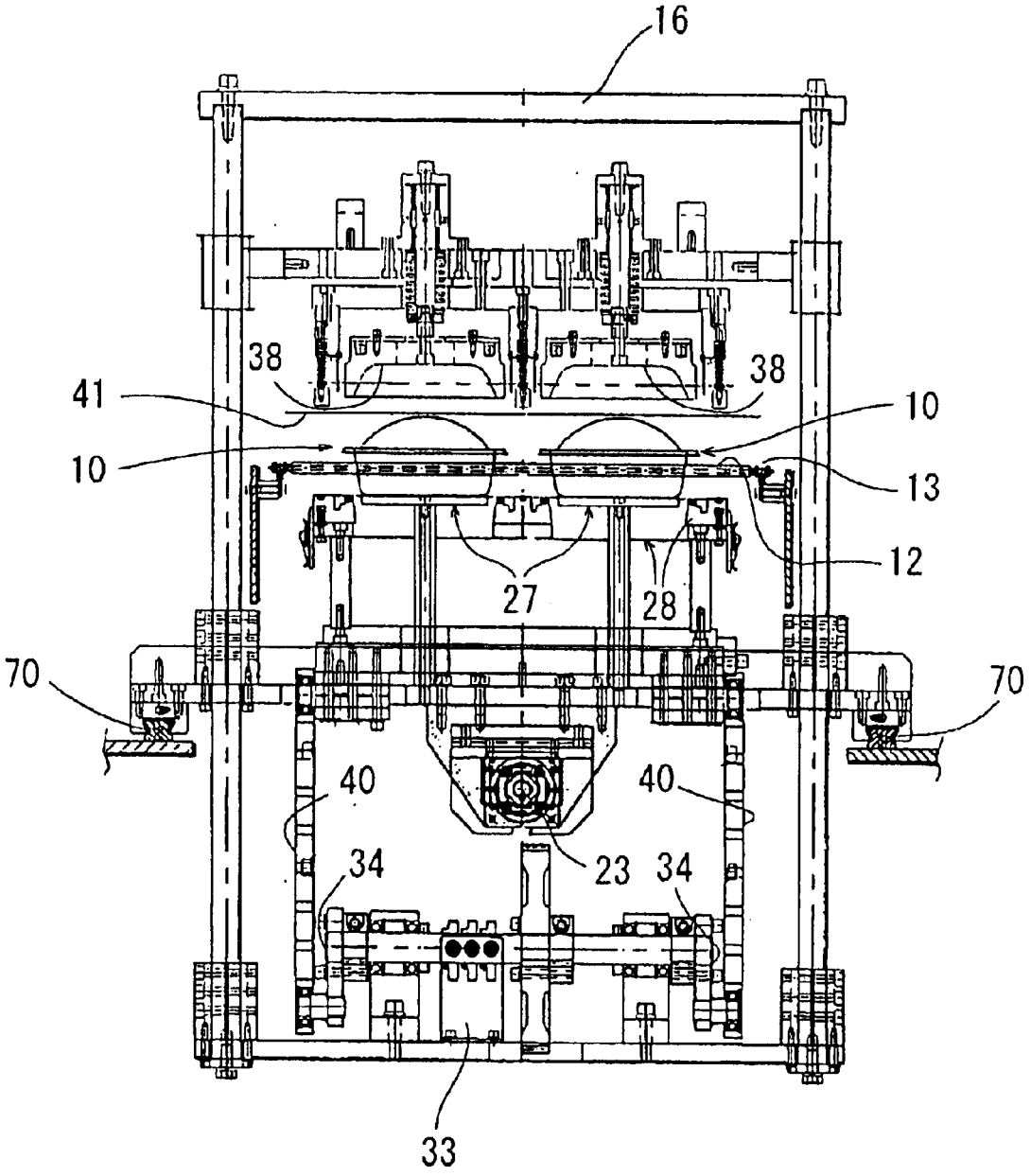
FIG. 3 is a front view of the device according to the present invention.

The general frame 16, which is illustrated from a different direction in FIG. 3, moves back and forth along the two side rails 70 due to the rotation of the screw bar 23, as described previously. On the other hand, the motive force transmitted from the motor 33 to the crank 34 causes the sealing base frame 28 to move upwards and downwards, by means of the con rods 40. Moreover, in the general frame 16, two sealers 38 having the same profile as the open edge of the trays 10 are supported and arranged respectively in the regions above the two bridge plates 27.

Figure 4:
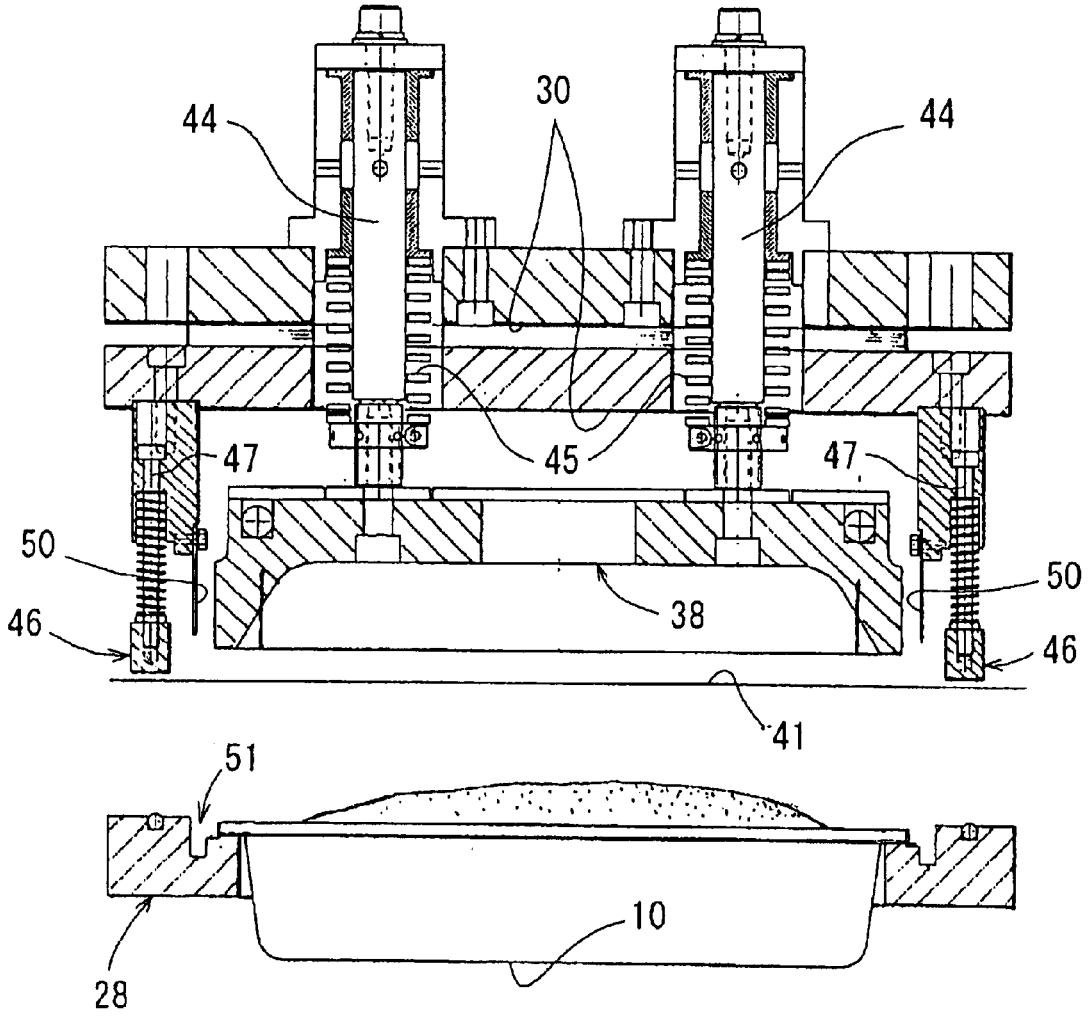
FIG. 4 is a partial enlarged side view of the device according to the present invention.

The sealers 38, which have an inverted bowl shape, as illustrated in enlarged view in FIG. 4, connect with the lower ends of a plurality of spindles 44 supported slidably on a two-stage upper section fixed plate 30. Furthermore, elastic resistance members 45 respectively formed by coil springs are disposed about each of the spindles 44. Moreover, a plurality of rod members 47 are suspended movably in the vertical direction, from the fixed plate 30, in such a manner that they connect with the perimeters of the sealers 38, a rubber block 46 being provided respectively on the lower end of each of the rod members 47, thereby forming film pushing elements. An endless blade 50 is installed on the inner side of each of the pushing elements 46, and continuous grooves 51 are formed on the upper face of the lower sealing base frame 28, in such a manner that the endless blades 50 can be inserted into same.

On the other hand, a band-shaped film 41 disposed over the conveyance path 11 and following same is moved at the same speed as the chains 13, by the winding movement of a reel 42, and the speed of advance of the general frame 16 is also the same as the speed of the film 41.

Figure 6:
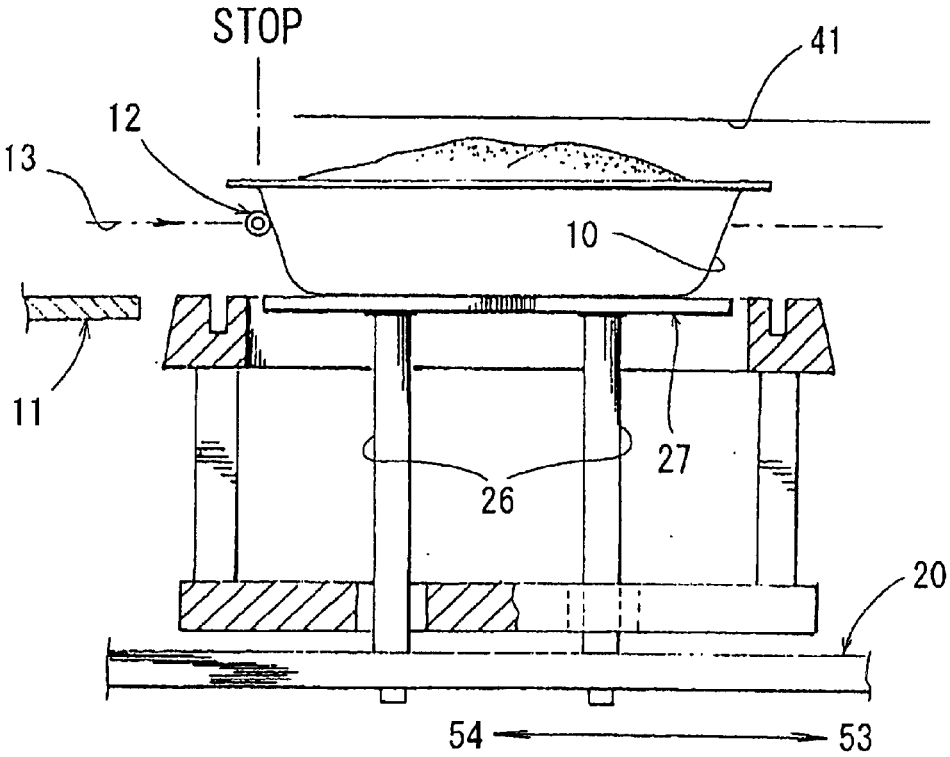
FIG. 6 is an enlarged side view of a sealing base.
Figure 7:
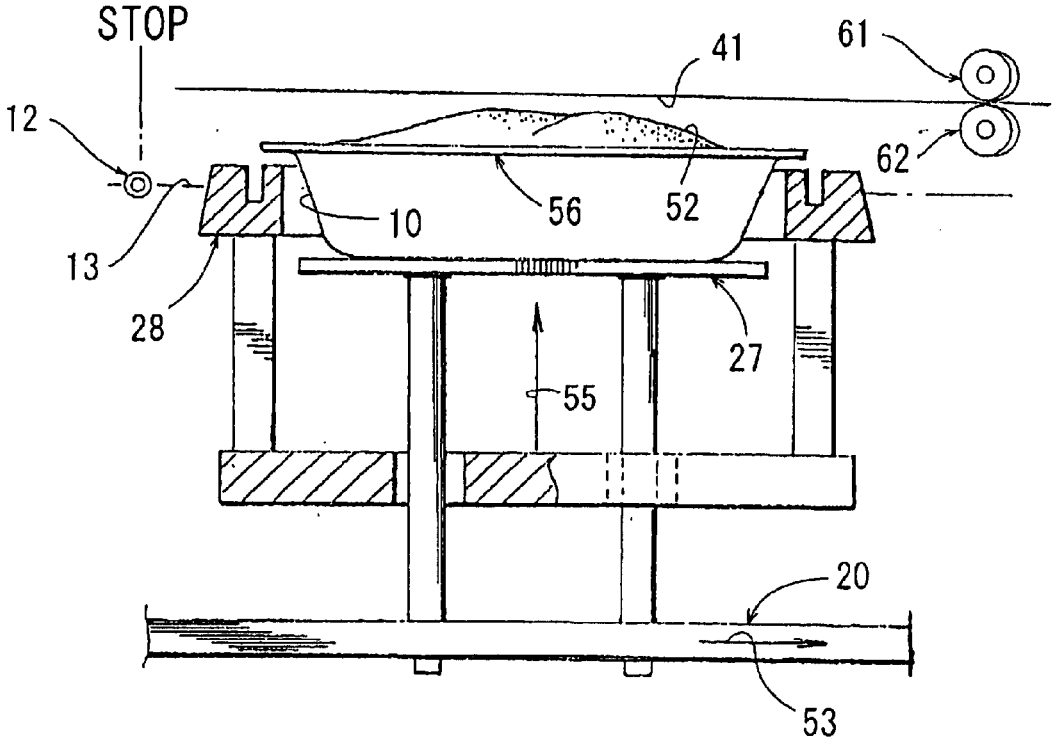
FIG. 7 is a diagram for describing the action of the sealing base.

The intermediate plate 20 of the general frame in FIG. 6 performs reciprocal movement in the direction of the arrows 53, 54, in association with the bridge plates 27. At the time when the movement of the intermediate plate 20 reaches the end section of the arrow 54, the touch bar 12 causes the trays 10 to move from the conveyance path 11 to the bridge plates 27, and, at that instant, the chains 13 halt temporarily. Immediately thereafter, the movement of the intermediate plate 20 changes to the direction of arrow 53, as illustrated in FIG. 7, and, simultaneously, the sealing base frame 28 starts to rise up, as the arrow 55 indicates, between the touch bar 12 and the bridge plates 27, and the chains 13 start operation again in such a manner that the intermediate plate 20 is advanced. The sealing base frame 28 is moved further upwards during this action, and, by supporting the rim portion 56 at the perimeter edge of the tray 10, it pushes the item to be packaged 52, provided in a mounded fashion rising above the tray 10, towards the band-shaped film 41.

Figure 5:
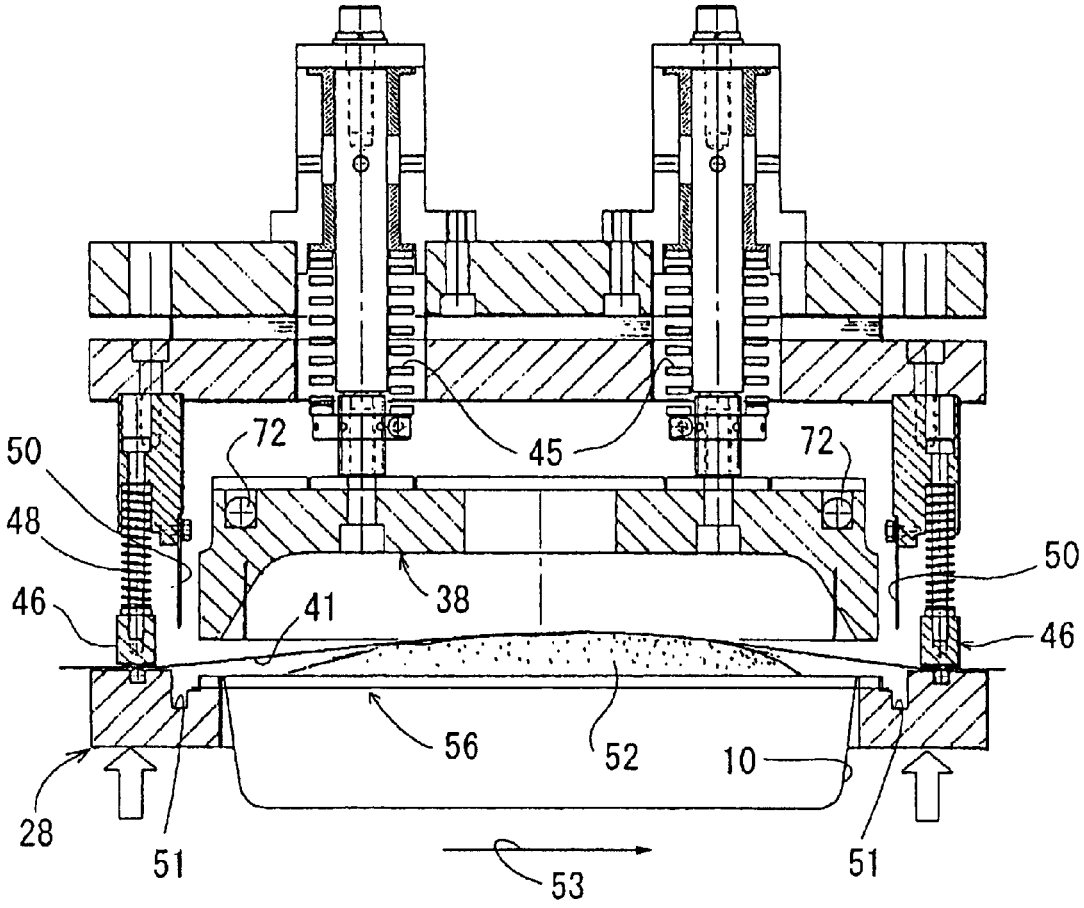
FIG. 5 is an action diagram relating to the previous diagram.

Due to further raising (as indicated by the arrow) of the sealing base frame 28 illustrated in FIG. 5, the sealing base frame 28 compresses a spring 48 provided above each of the pushing elements 46, and the film at the periphery of the tray 10 is held between the sealing base frame 28 and the pushing elements 46, while the film 41 is held under pressure between the sealers 38 and the sealing base frame 28 by means of the reaction force of the elastic resistance members 45. In this case, since the sealers 38 are heated by thermoelectric wiring 72, the film 41 is pressed against the rim portion 56 of the open edge of the tray 10 and is welded to same. Thereupon, the endless blades 50 which insert into the grooves 51 cut out the film 41 along the outline of the tray 10.

Figure 9:
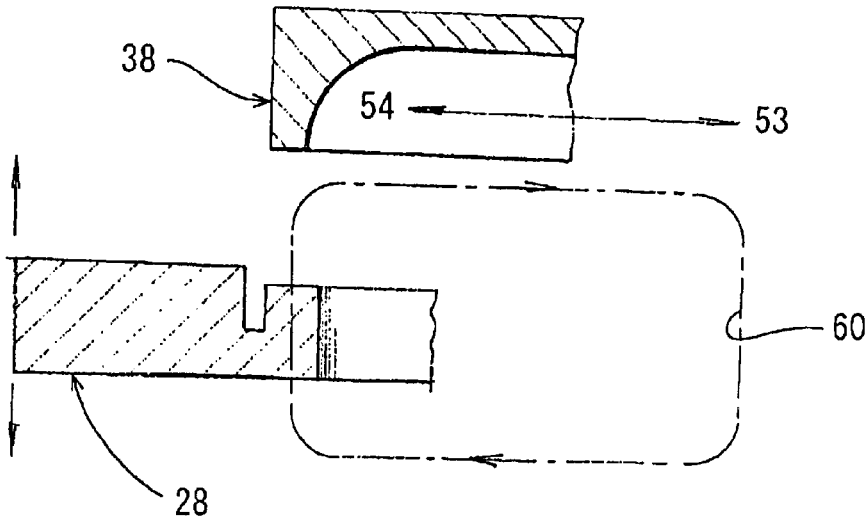
FIG. 9 is a diagram for describing the action of a sealing mechanism.

As a result of the sealers 38, which are partially illustrated in FIG. 9, moving back and forth constantly in the direction of the arrows 53, 54, and of the seal base 28 moving upwards and downwards constantly, the seal base 28 performs a box motion operation as illustrated by the dotted line 60 in the diagrams, due to the combined action of these two movements.

FIG. 13 shows the sequences of the respective movements of the general frame 16 and the band-shaped film 41 described previously, as well as the sealing base frame 28 and the touch bar 12. In other words, the band-shaped film 41 always performs a forward movement at a uniform speed, whereas the general frame 16 repeats a reciprocal movement of advance and retreat over a prescribed area. At the same time, the sealing base frame 28 repeats a raising and lowering motion, in order that it performs a box motion operation together with the reciprocal movement of the general frame 16. The touch bars 12 advance constantly, but they halt temporarily, only while the sealing base frame 28 is raised, in such a manner that they do not interfere with the movement of the sealing base frame.

Therefore, as the sealing base frame 28 and the sealers 38 perform reciprocal movement following the band-shaped film 41 and trays 10 which move in the direction of the arrow 53 in FIG. 5, packaging operations are successively repeated, but when an item to be packaged 52 which is in a mounded state pushes upwards on the band-shaped film 41, a wave is applied unavoidably to that film 41. However, the portion where the sealer 38 presses down against the band-shaped film 41 does not lie in the region containing a large number of small pleats situated on the outer side of the pushing elements 46, but rather, it lies to the inside of the pushing elements 46, and hence there are relatively few wrinkles in the film that is welded to the rim portion 56 of the tray 10.

Figure 10:
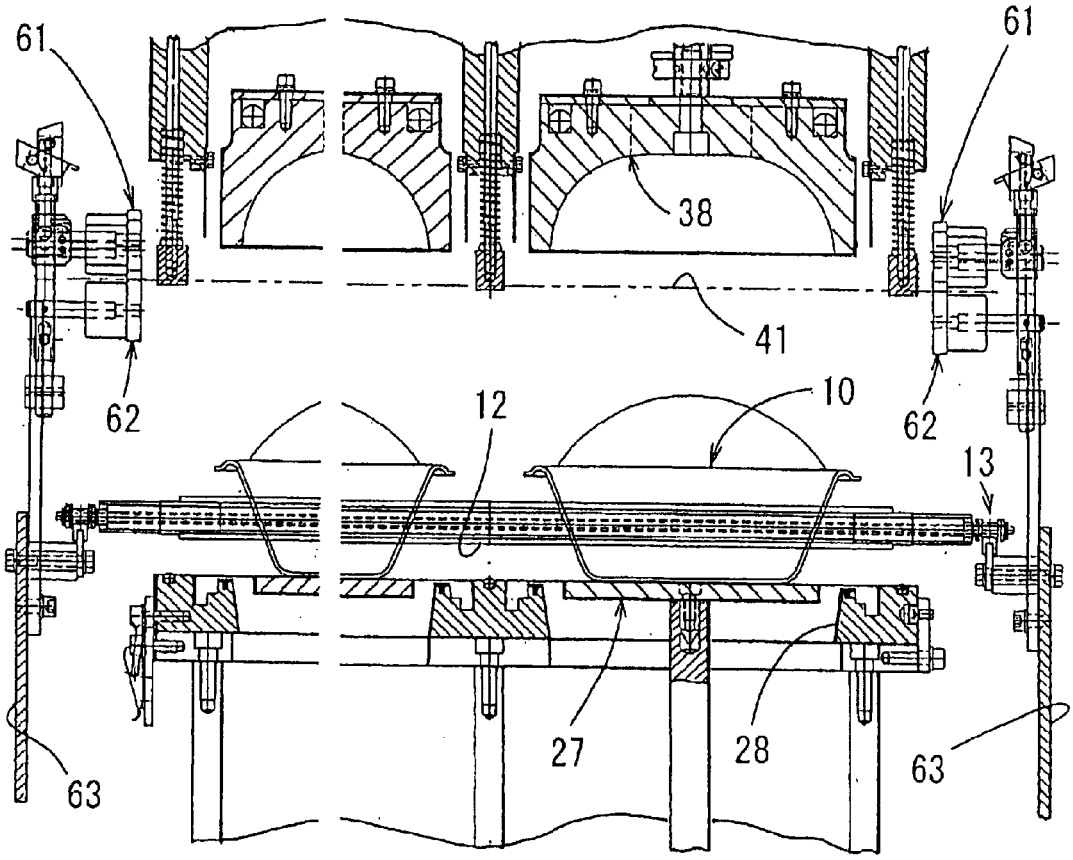
FIG. 10 is a partial front view of the device according to the present invention.

As shown in FIG. 10, in the detailed composition of the rollers 61, 62 disposed to the rear of the general frame 16 in FIG. 1, the two side edges of the band-shaped film 41 are respectively held between pairs of upper and lower driving rollers 61, 62, and these rollers are supported and arranged on an immobile machine platform 21, that is different to the general frame 16 which is constantly being displaced, in other words, they are supported on the machine platform 63 of the device.

Figure 11:
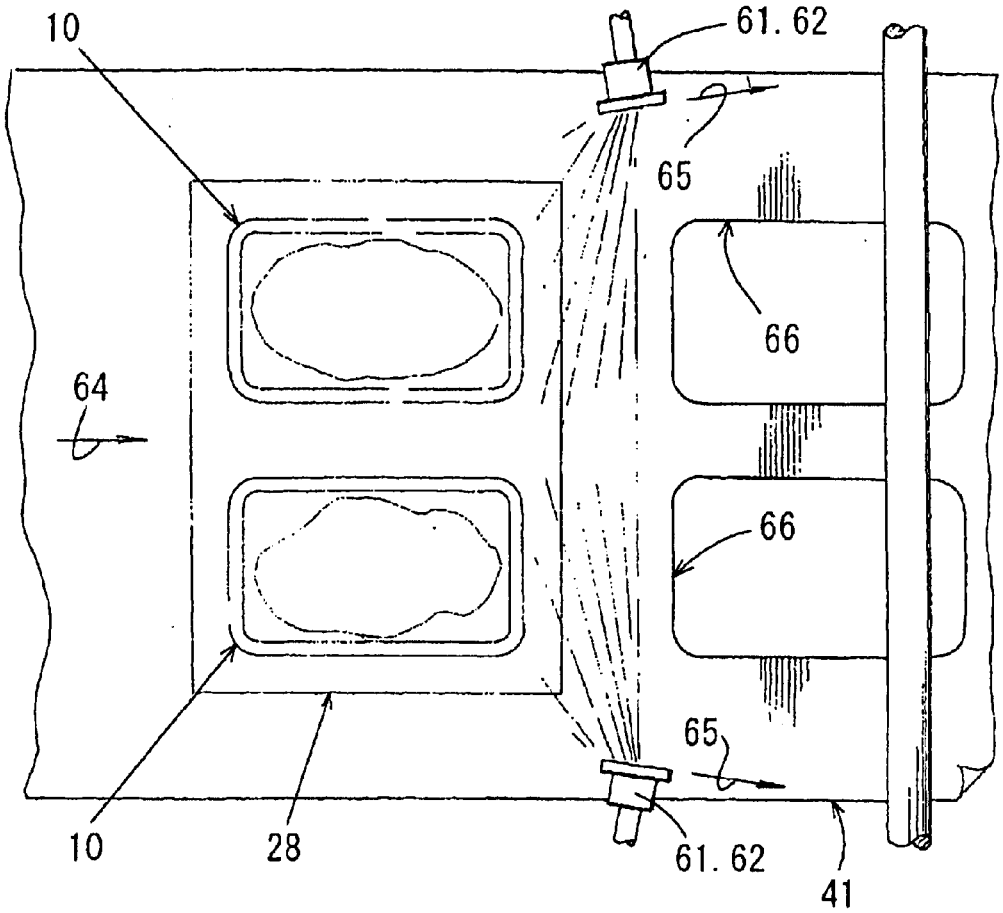
FIG. 11 is a plan view of a device for removing wrinkles in the film.

Moreover, as shown in FIG. 11, the rollers 61, 62 on either side are disposed at an inclined angle in such a manner that the band-shaped film 41 is tensioned towards either side, in the direction of travel thereof (arrow 64). In other words, the rollers 61, 62 are positioned at an angle of inclination which is suitable for directing the film 41 in the directions of the arrows 65. Furthermore, these directing rollers 61, 62 are each provided internally with a one-way clutch which permits the rollers 61, 62 to perform free rotation only in the direction of travel 64 of the band-shaped film 41. Although the film 41 loses tensioning effects in the lateral directions due to the cutaway holes 66 of the film that have been cut out in the previous step, and although distortion occurs in the film 41, giving rise to wrinkles, in the vicinity of the cutaway holes 66 on the forward side of the sealing base frame 28 in the direction of travel 64, since the rollers 61, 62 situated at this position do not turn in the reverse direction, the film 41 is pulled and tensioned in the direction of either side only, and hence the generation of wrinkles in the film 41 welded to the tray 10 is prevented in advance.

Figure 12:
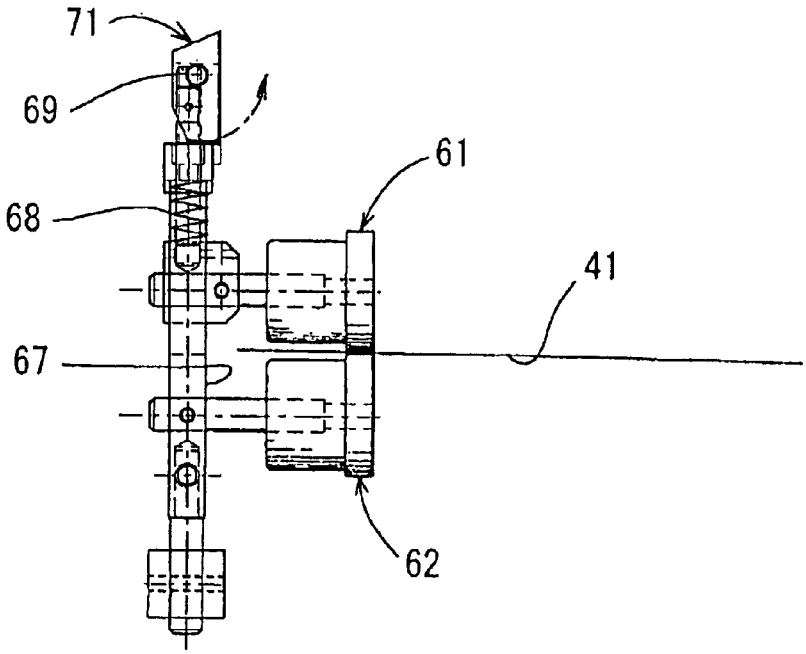
FIG. 12 is an enlarged front view of the rollers.

FIG. 12 shows a guide 67 which supports the respective rollers 61, 62, the axle of the lower roller 62 being supported on the guide 67 in such a manner that it cannot be displaced in the upward or downward direction, whereas the upper roller 61 is able to be displaced upwards or downwards along the guide 67, the both rollers 61, 62 holding the film 41 under pressure between them constantly due to the reaction force of a coil spring 68, and, by releasing a pressure contact element 71 in the direction of the arrow, taking the pin 69 as an axis, it is possible to create a gap between both rollers 61, 62 and thereby to facilitate the insertion of the film 41 therebetween.

Second Embodiment

A second embodiment has a composition wherein the respective members illustrated in FIG. 14 are caused to operate as illustrated in the diagram. In other words, a general frame 16 repeats reciprocal movement of advancing and retreating through a prescribed area. A sealing base frame 28 performs a box motion operation, in association with the reciprocal movement of the general frame 16, and hence it repeats rising and descending movements. The touch bars 12 advance constantly, but they are temporarily caused to retreat backwards a little in such a manner that they do not interfere with the rising of the sealing base frame 28. The film 41 constantly performs forward movement at a uniform speed, but it halts temporarily only when the sealing base frame 28 is raised from below.

Third Embodiment

Figure 15:
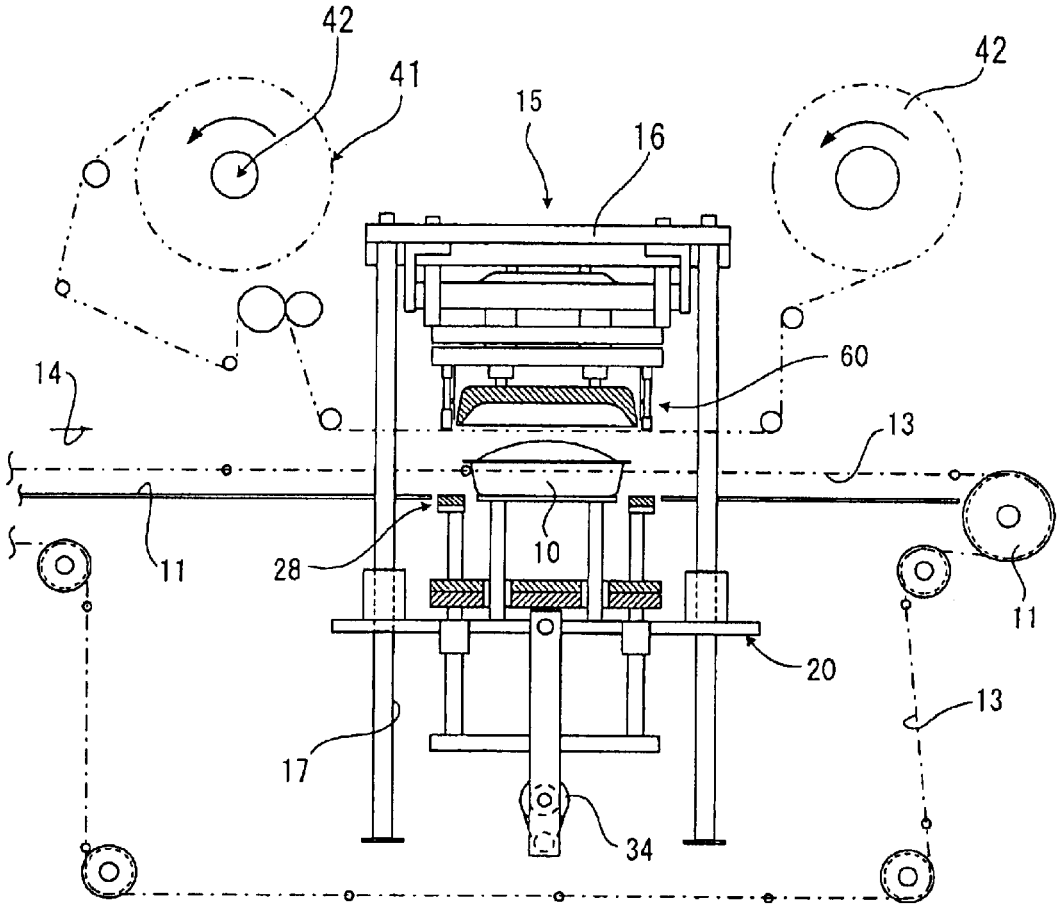
FIG. 15 is a side view of a device according to a third embodiment.
Figure 16:
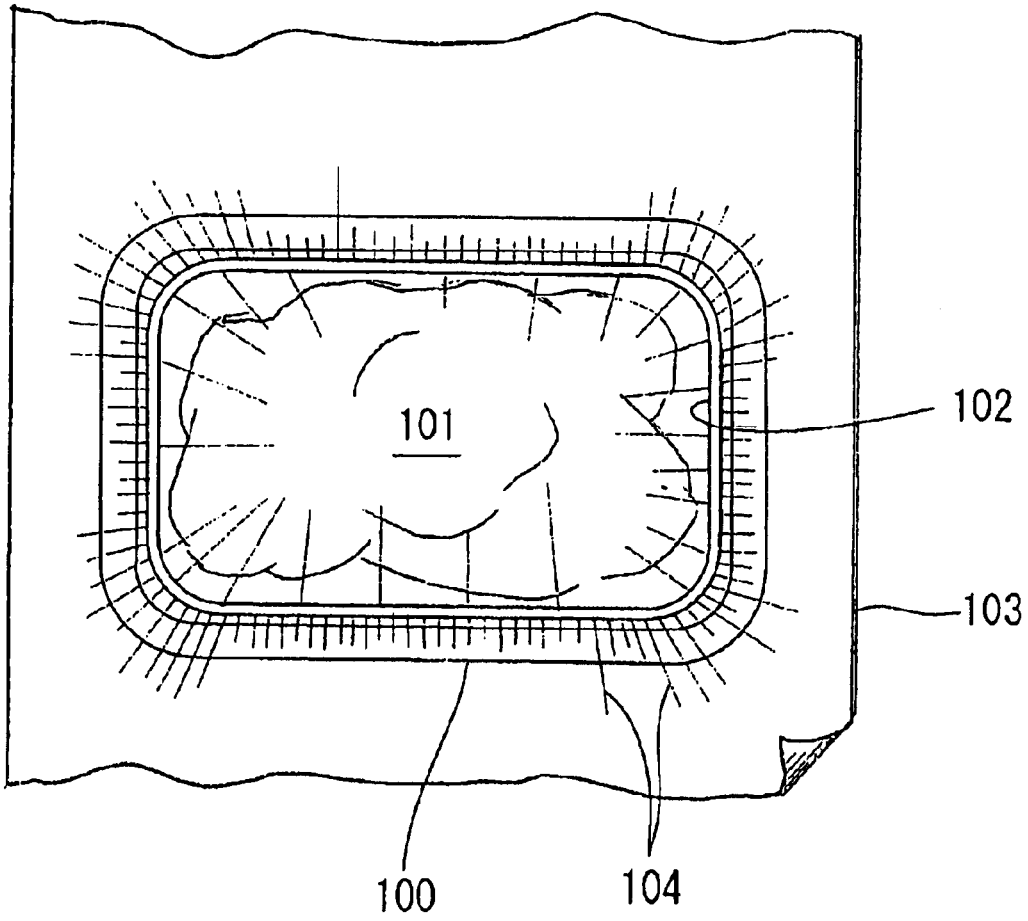
FIG. 16 PRIOR ART
FIG. 16 is an illustrative diagram of a prior art example.

FIG. 15 shows a device according to a third embodiment. The composition of this third embodiment is such that a general frame 16 provided in a cutaway region 15 in an intermediate part of the conveyance path 11 is fixed and does not perform reciprocal movement. Therefore, the female screw block 24, screw bar 23, servo motor 25, finger shaped bars 35 and transfer regions 36, and the like, are not provided, but since the basic composition is the same, the same reference numerals are used and detailed description thereof is omitted here.

In this third embodiment, touch bars 12 performing intermittent movement push respective trays 10 on a conveyance path 11 and advance same onto bridge plates 27 which are fixed to a general frame 16. In order to avoid collision between the touch bar 12 and the sealing base frame 28 which rises upwards, the touch bar 12 is temporarily caused to retreat backwards. When the sealing base frame 28 is raised upwards by the lifting mechanism, then the band-shaped film 41 is temporarily halted. Therefore, the band-shaped film 41 moves in an intermittent fashion. While the band-shaped film 41 is temporarily halted, the sealing base frame 28 is raised up, and by supporting a rim portion 56 at the perimeter edge of the tray 10, it pushes the item to be packaged 52, which is positioned in a mounded state in the tray, upwards in the direction of the band-shaped film 41. Thereupon, the film 41 is pressed against and welded to the rim portion 56 of the open edge of the tray 10, and endless blades 50 cut the film 41 along the outline of the tray 10.

What is claimed is:

1. A device for sealing and packaging cover film onto a tray having open edge and accommodating an item in a mounded fashion, comprising:

a pair of endless chains;

a plurality of touch bars spanning between the endless chains at equidistant intervals;

means for moving the endless chains and the touch bars in unison for pushing and advancing respective trays disposed in said equidistant intervals along an upper surface of a horizontal conveyance path;

a general frame moving back and forth reciprocally in a parallel direction with said touch bars and in a defined region of said conveyance path;

bridge plates fixed to said general frame for moving back and forth reciprocally in unison with said general frame in said defined region and at the same height as the upper surface of said conveyance path;

a sealing base frame disposed surrounding said bridge plates for supporting the open edge of the tray;

a lifting mechanism for moving said sealing base frame upwards and downwards about the periphery of said bridge plates in response to the reciprocal movement of said frame;

sealers fixed to said general frame above said sealing base frame and having the same outline as the open edge of the tray supported on said sealing base frame;

a film conveyance mechanism for moving a band-shaped film between said sealers and said bridge plates, in the same direction as said touch bars;

a film pushing element disposed in an isolated fashion about a periphery of said sealers; and an endless blade having the same outline as the outline of the tray and disposed surrounding the periphery of said sealers;

wherein, when said lifting mechanism performs an upward movement, said band-shaped film is pressed by said sealing base frame against film pushing elements, and with further upward movement of the lifting mechanism, said band-shaped film is pressed against and welded by said sealers to the open edge of the tray supported on said sealing base, while said band-shaped film is pushed upwards by a to-be-packaged item accommodated in said tray in said mounded fashion, and furthermore, said band-shaped film is pressed against said endless blade and is cut out in accordance with the outline of said tray.

2. The device for sealing and packaging cover film onto a tray according to claim 1, further comprising pairs of cooperating upper and lower directing rollers for gripping respective side edges of the band-shaped film;

wherein said pairs of rollers are supported and arranged on an immobile machine platform differing from the general frame at respective sides downstream of said sealing base frame, these rollers on either side being arranged at an inclined angle in such a manner that said band-shaped film is tensioned towards said either side, in the direction of travel thereof; and wherein, a one-way clutch whereby each roller is able to perform free rotation only in the direction of travel of said band-shaped film is disposed inside each of the directing rollers.

3. The device for sealing and packaging cover film onto a tray according to claim 1, further comprising upstream transfer fingers and downstream transfer fingers disposed in said defined region of the conveyance path, wherein said transfer fingers are configured to extend and contract in accordance with the reciprocal movement of said general frame to transfer said trays from said conveyance path upstream of the general frame to said bridge plates and from said bridge plates to said conveyance path downstream of the general frame.

4. The device for sealing and packaging cover film onto a tray according to claim 1, wherein the movement of the touch bars at the moment that the sealing base frame is pushed up towards the sealers is halted temporarily while said sealing base frame is raised up above said touch bars.

5. The device for sealing and packaging cover film onto a tray according to claim 1, wherein the film is temporarily halted and the touch bars are temporarily caused to retreat, at the moment that the sealing base frame is pushed up towards the sealers.

6. A device for sealing and packaging cover film onto a tray having open edge and accommodating an item in a mounded fashion, comprising:

a pair of endless chains;

a plurality of touch bars spanning between the endless chains at equidistant intervals;

means for moving the endless chains and the touch bars in unison for pushing and advancing respective trays disposed in said equidistant intervals along an upper surface of a horizontal conveyance path;

a general frame fixed in a defined region of said conveyance path;

bridge plates fixed on said general frame in said defined region and at the same height as the upper surface of said conveyance path;

a sealing base frame disposed surrounding said bridge plates for supporting the open edge of the tray;

a lifting mechanism for moving said sealing base frame upwards and downwards about the periphery of said bridge plates;

sealers fixed to said general frame above said sealing base frame and having the same outline as the open edge of the tray supported on said sealing base frame;

a film conveyance mechanism for moving a band-shaped film between said sealers and said bridge plates, in the same direction as said touch bars;

a film pushing element disposed in an isolated fashion about a periphery of said sealers; and an endless blade having the same outline as the outline of the tray and disposed surrounding the periphery of said sealers;

wherein, when said lifting mechanism performs an upward movement, said band-shaped film is pressed by said sealing base frame against film pushing elements, and with further upward movement of the lifting mechanism, said band-shaped film is pressed against and welded by said sealers to the open edge of the tray supported on said sealing base, while said band-shaped film is pushed upwards by a to-be-packaged item accommodated in said tray in said mounded fashion, and furthermore, said band-shaped film is pressed against said endless blade and is cut out in accordance with the outline of said tray.

7. The device according to claim 6, wherein the touch bars are caused temporarily to retreat at the moment that the sealing base frame is pushed upwards towards the sealers, thereby avoiding collision between the touch bars and the sealing base frame.

* * * * *